US008505547B2

(12) United States Patent
Bao

(10) Patent No.: US 8,505,547 B2
(45) **Date of Patent: *Aug. 13, 2013**

(54) PIPE LIGHTER

(76) Inventor: Fan Bao, City of Industry, CA (US)

( * ) Notice: Subject to any disclaimer, the term of this patent is extended or adjusted under 35 U.S.C. 154(b) by 179 days.

This patent is subject to a terminal disclaimer.

(21) Appl. No.: 13/066,485

(22) Filed: Apr. 15, 2011

(65) Prior Publication Data

US 2011/0192407 A1 Aug. 11, 2011

Related U.S. Application Data

(63) Continuation-in-part of application No. 12/291,809, filed on Nov. 12, 2008, now Pat. No. 8,109,275.

(51) Int. Cl.
*A24F 3/00* (2006.01)

(52) U.S. Cl.
USPC ..... 131/185

(58) Field of Classification Search
USPC ..... 131/185
See application file for complete search history.

(56) References Cited

U.S. PATENT DOCUMENTS 8,109,275 B2 * 2/2012 Bao ..... 131/185

* cited by examiner

*Primary Examiner* — Richard Crispino
*Assistant Examiner* — Dionne Walls Mayes
(74) *Attorney, Agent, or Firm* — Raymond Y. Chan; David and Raymond Patent Firm

(57) ABSTRACT

A pipe lighter includes a lighter apparatus coupling with an inhaler apparatus. The inhaler apparatus includes a crucible unit coupled with the housing sidewall of the lighter housing and a tubular inhaling guider extended from the crucible unit, wherein the crucible unit has a substance chamber positioned adjacent to a flame opening of the lighter apparatus for retaining a smoking substance in the substance chamber, and a burner unit which is sized to fittingly and complimentarily engaging with the crucible unit to cover and evenly distribute the heat inside the substance chamber, thereby the smoking is evenly burnt which is then guided to flow towards the tubular inhaling guider. The pipe lighter is compact in size which substantively the same size as a disposable lighter, and is convenience to carry and use.

20 Claims, 9 Drawing Sheets

PIPE LIGHTER

CROSS REFERENCE OF RELATED APPLICATION

This is a Continuation-In-Parts application that claims the benefit of priority under 35 U.S.C. §119 to a non-provisional application Ser. No. 12/291,809, filed Nov. 12, 2008 now U.S. Pat. No. 8,109,275.

BACKGROUND OF THE PRESENT INVENTION

1. Field of Invention

The present invention relates to a lighter, and more particularly to a pipe lighter which comprises a lighter apparatus equipped with an inhaler apparatus to form a single portable apparatus for enhancing the practice use of the inhaler apparatus.

2. Description of Related Arts

A pipe is a common tool for tobacco smoking and typically consists of a small chamber for the combustion of tobacco. Generally, the pipe is commonly made of briar, corncob, meerschaum, and clay. People who want smoking usually carry a lighter to ignite the tobacco inside the pipe. However, no matter which type of pipe is, the smokers must carry the lighter or other lighting tool in order to ignite the tobacco. Accordingly, how to carry the smoking substance is another issue. Therefore, the smokers must need to bring a lot of smoking tools at the same time and this causes inconvenience for people who smoke.

On the other hand, the smokers usually have the experience of borrowing other people's lighter to ignite the tobacco. Even though the smoker may have the lighter and the pipe on hand, it is not guaranteed that the user can be able to directly aim the flame at the smoking substance. In other words, it is not easy for people to ignite the tobacco in outdoor environment, especially in a windy condition.

Moreover, cleaning the pipe after smoking is a big issue for maximizing and extending the life span of the pipe. Some people use a pipe tool to clean out the ash and unburned tobacco. However, for some small pipes or long channel pipes, it is hard for people to clean the ash and the last bits out by using a pipe tool. If the unburned tobacco and the ash doesn't come out during last clean, the flavor of the cigarette or the tobacco dramatically ruined by the residue element. Finally, the smokers usually require a tool for adjusting, packing and emptying the tobacco inside the pipe, and a regular supply of pipe cleaners. The size of the pipe and the tool for cleaning pipe are usually bulky, and hard for people to carry them on hand.

Also, when burning smoking substance in the combustion chamber of the pipe, an uneven burning is resulted owing to failure to provide an efficient ignition or burning mechanism. The smoking substance on the uppermost layer or in the centre area of the combustion chamber may easily get burnt while the smoking substance beneath the uppermost layer or in the peripheral area of the combustion chamber may be wasted without being burnt.

SUMMARY OF THE PRESENT INVENTION

An object of the present invention is to provide a pipe lighter, which comprises a lighter apparatus equipped with an inhaler apparatus to form a single portable apparatus for enhancing the practice use of the inhaler apparatus.

Another object of the present invention is to provide a pipe lighter, wherein the flame opening of the lighter apparatus is positioned adjacent to the substance chamber of the inhaler apparatus, in such a manner that when the lighter apparatus is actuated to produce the flame at the flame opening, the smoking substance is instantly burnt so as to allow the smoker to smoke via the inhaler apparatus.

Another object of the present invention is to provide a pipe lighter, wherein the inhaler apparatus is pivotally coupled with the lighter apparatus such that the pipe lighter is adapted to fold at a compact folded position for enhancing the portability of the pipe lighter and is adapted to fold at an unfolded position for the smoker to smoke right the way.

Another object of the present invention is to provide a pipe lighter, wherein the flame opening of the lighter apparatus is enclosed by the inhaler apparatus when the pipe lighter is folded at the folded position so as to prevent the lighter apparatus from being actuated accidentally.

Another object of the present invention is to provide a pipe lighter, which provides a substance compartment at a side housing for containing the smoking substance such that the smoker is able to carry extra smoking substance in hand.

Another object of the present invention is to provide a pipe lighter, wherein the inhaler apparatus can be precisely folded between the folded position and the unfolded position because the side housing provides two folding guides for limiting a pivotal movement of the inhaler apparatus.

Another object of the present invention is to provide a pipe lighter, wherein the side housing has a trapezoid shape such that the side housing is designed for the smoker to easily access the substance compartment for depositing or withdrawing the smoking substance thereat.

Another object of the present invention is to provide a pipe lighter, wherein the lighter housing further has a plurality of ventilating holes spacedly formed on the housing sidewall of the lighter housing to maintain continuity of enough fresh air supplies and to prevent the heat accumulating within the lighter housing.

Another object of the present invention is to provide a pipe lighter, wherein the inhaling guilder is detachable, such that the user is able to easily clean the inhaling guilder.

Another object of the present invention is to provide a pipe lighter, wherein the pipe lighter provides a piezoelectric-type lighter such that the user is able to lighten the smoking tool in outdoor windy condition.

Another object of the present invention is to provide a pipe lighter, wherein the pipe lighter provides a smart burner unit for creating an oven chamber which provides an improved burning effect for the smoking substance.

Another object of the present invention is to provide a pipe lighter, wherein the pipe lighter provides a smart burner unit comprising a heating member in the burner unit such that heat is evenly spread or reflected in the oven chamber which provides an improved burning effect for the smoking substance.

Additional advantages and features of the invention will become apparent from the description which follows, and may be realized by means of the instrumentalities and combinations particular point out in the appended claims.

Accordingly, in order to accomplish the above objects, the present invention provides a pipe lighter comprising a lighter apparatus and an inhaler apparatus coupling with the lighter apparatus.

The lighter apparatus comprises a lighter housing having a housing sidewall, a flame opening provided at the housing sidewall, and a fuel storage chamber for storing liquefied gas therewithin, an ignition unit supported within the lighter housing, a flame nozzle operatively extended from the fuel storage chamber to the flame opening for releasing the gas in a controllable manner, and an actuator which is movably supported on the lighter housing and is arranged in such a manner that when the actuator is depressed, the gas in the fuel storage chamber is released towards the flame nozzle while the ignition unit is activated for igniting the gas at the flame nozzle so as to produce a flame through the flame opening.

The inhaler apparatus comprises a crucible unit coupled with the housing sidewall of the lighter housing and a tubular inhaling guider extended from the crucible unit, wherein the crucible unit has a substance chamber positioned adjacent to the flame opening of the lighter housing for retaining a smoking substance in the substance chamber, such that the lighter apparatus is actuated to produce a flame for a combustion of the smoking substance to be smoked and for an inhalation of smoked through the inhaling guider.

In accordance with another aspect of the invention, the present invention provides a pipe light which comprises:

a lighter apparatus which comprises a lighter housing having a housing sidewall, a flame opening provided at the housing sidewall, and a fuel storage chamber for storing liquefied gas therewithin, an ignition unit supported within the lighter housing, a flame nozzle operatively extended from the fuel storage chamber to the flame opening for releasing the gas in a controllable manner, and an actuator which is movably supported on the lighter housing and is arranged in such a manner that when the actuator is depressed, the gas in the fuel storage chamber is released towards the flame nozzle while the ignition unit is activated for igniting the gas at the flame nozzle so as to produce a flame through the flame opening; and an inhaler apparatus which comprises a crucible unit coupled with the housing sidewall of the lighter housing and a tubular inhaling guider extended from the crucible unit, wherein the crucible unit has a substance chamber positioned adjacent to the flame opening of the lighter housing for retaining a smoking substance in the substance chamber, such that the lighter apparatus is actuated to produce the flame for a combustion of the smoking substance to be smoked and for an inhalation of the smoked through the inhaling guider.

In particular, the crucible unit has a coupling sidewall pivotally coupling with the housing sidewall of the lighter housing to enable the inhaler apparatus to pivotally move between a folded position that the flame opening is covered by the coupling sidewall of the crucible unit for preventing the flame being produced at the flame opening, and an unfolded position that the crucible unit is pivotally folded until the substance chamber thereof is positioned adjacent to the flame opening of the lighter housing.

Preferably, the inhaling guider has a mouth-piece end, an opposed coupling end coupling with the crucible unit, and an inhaler channel extended from the coupling end to the mouth-piece end to communicate with the substance chamber for an inhalation of the smoked through the inhaling guider. Preferably, the coupling end of the inhaling guider is detachably coupled with the crucible unit.

The pipe lighter further comprising a side housing sidewardly and integrally extended from the housing sidewall of the lighter housing, wherein the side housing has a top wall and a front wall arranged in such a manner that when the inhaler apparatus is pivotally folded at the folded position, the inhaling guider is folded to overlay on the front wall of the side housing, and when the inhaler apparatus is pivotally folded at the unfolded position, the crucible unit is folded to overlay on the top wall of the side housing, such that the front wall and the top wall of the side housing form as two folding guides for limiting a pivotal movement of the inhaler apparatus between the folded and unfolded positions.

In particular, the side housing has a substance compartment formed at the front wall for containing the smoking substance to be smoked within the substance compartment, and comprises a compartment cover pivotally coupled at the front wall to pivotally enclose the substance compartment.

Preferably, the side housing has a trapezoid shape that a cross-sectional area of the substance compartment is gradually reducing towards the top wall.

It is appreciated that said inhaler apparatus is perpendicularly extended from said lighter apparatus when said inhaler apparatus is folded at said unfolded position, while said inhaler apparatus is parallely extended from said lighter apparatus to overlap said coupling sidewall with said housing sidewall when said inhaler apparatus is folded at said folded position so as to form a compact box-shaped structure.

Preferably, said lighter housing further has a plurality of ventilating holes spacedly formed on said housing sidewall of said lighter housing to communicate with an interior thereof for enhancing an air circulation of said lighter housing when said lighter apparatus is actuated for ignition.

It is appreciated that a burner unit is provided, which is sized to fittingly and complimentarily engaging with the crucible unit to cover and evenly distribute the heat inside the substance chamber, thereby the smoking is evenly burnt which is then guided to flow towards the tubular inhaling guider. The pipe lighter is compact in size which substantively the same size as a disposable lighter, and is convenience to carry and use.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
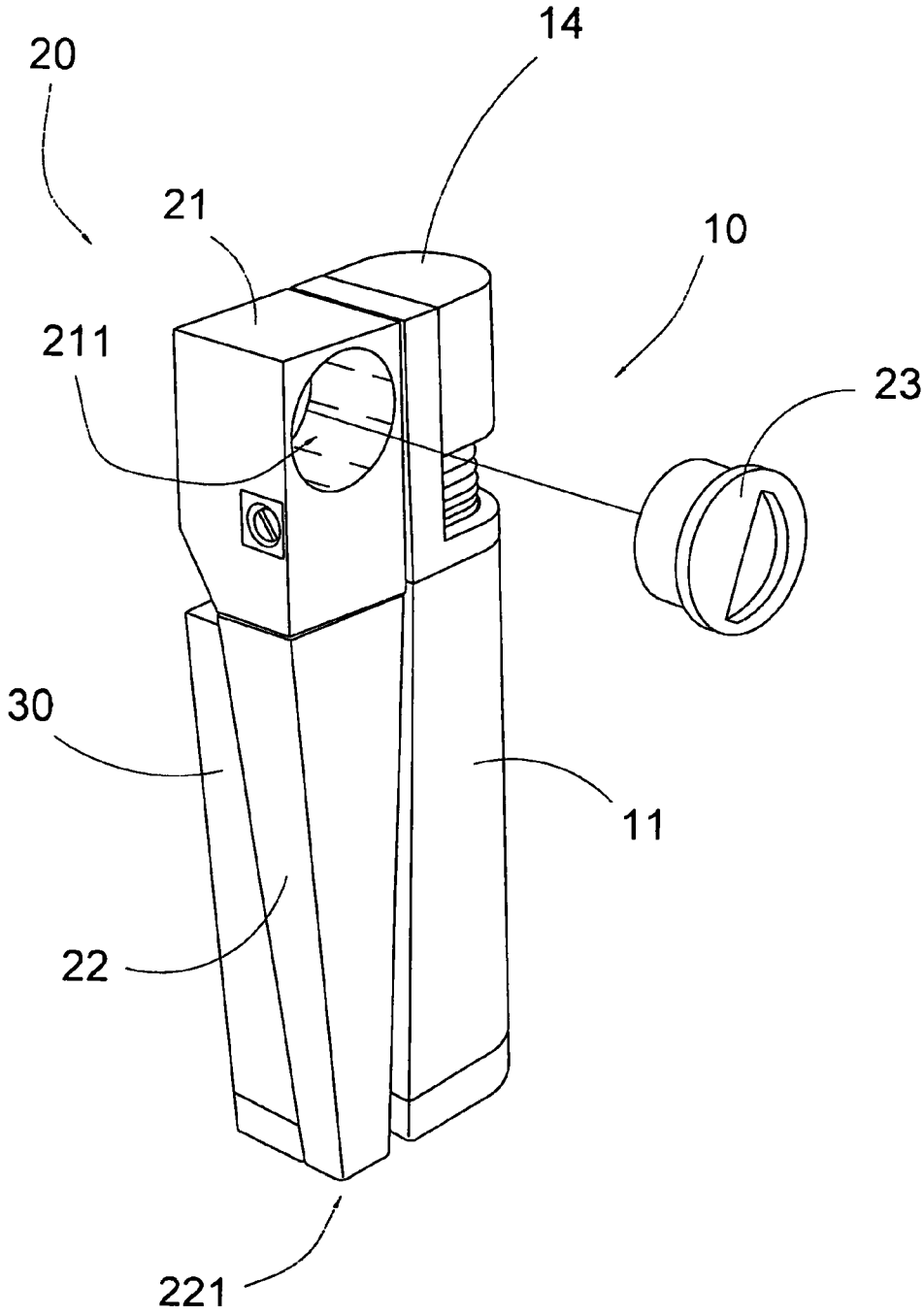
FIG. 1 is a perspective view of a pipe lighter according to a preferred embodiment of the present invention, illustrating the pipe lighter being folded at a folded position.
Figure 2:
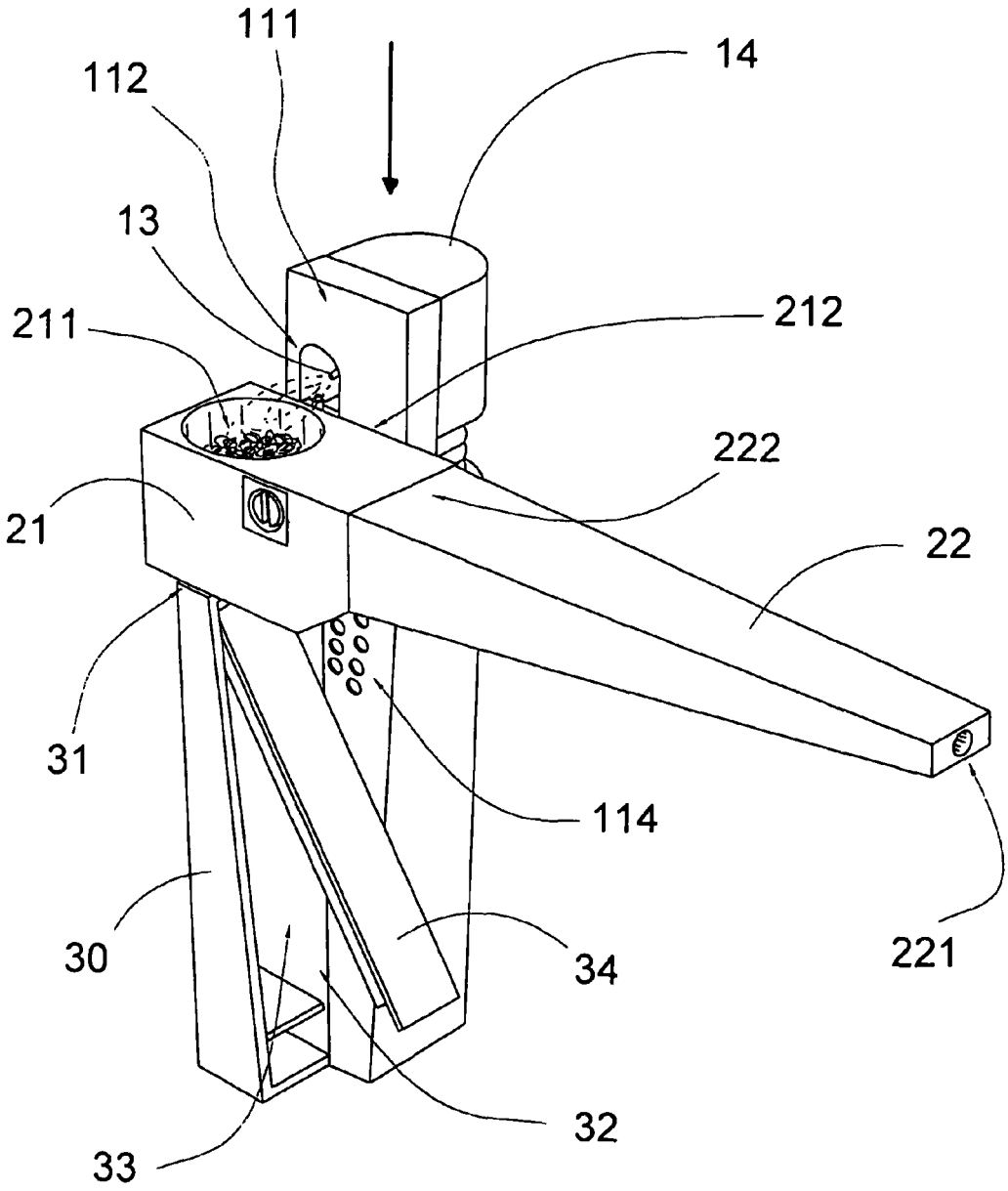
FIG. 2 is a perspective view of the pipe lighter according to the above preferred embodiment, illustrating the pipe lighter being folded at an unfolded position.

Referring to FIGS. 1 to 2 of the drawings, a pipe lighter according to a preferred embodiment of the present invention is illustrated, wherein the pipe lighter comprises a lighter apparatus 10 and an inhaler apparatus 20 coupling with the lighter apparatus 10.

The lighter apparatus 10 comprises a lighter housing 11 having a housing sidewall 111, a flame opening 112 provided at the housing sidewall 111, and a fuel storage chamber 113 for storing liquefied gas therewithin.

The lighter apparatus 10 further comprises an ignition unit 12 supported within the lighter housing 11, a flame nozzle 13 operatively extended from the fuel storage chamber 113 to the flame opening 112 for releasing the gas in a controllable manner, and an actuator 14 which is movably supported on the lighter housing 11 and is arranged in such a manner that when the actuator 14 is depressed, the gas in the fuel storage chamber 113 is released towards the flame nozzle 13 while the ignition unit 12 is activated for igniting the gas at the flame nozzle 13 so as to produce a flame through the flame opening 112.

The inhaler apparatus 20 comprises a crucible unit 21 coupled with the housing sidewall 111 of the lighter housing 11 and a tubular inhaling guider 22 extended from the crucible unit 21, wherein the crucible unit 21 has a substance chamber 211 positioned adjacent to the flame opening 112 of the lighter housing 11 for retaining a smoking substance in the substance chamber 211.

Accordingly, the lighter apparatus 10 is actuated to produce the flame for a combustion of the smoking substance to be smoked and for an inhalation of smoked through the inhaling guider 22.

According to the preferred embodiment, the lighter apparatus 10, which is embodied as a convention lighter, to enhance the operation of the lighter apparatus 10.

Figure 3:
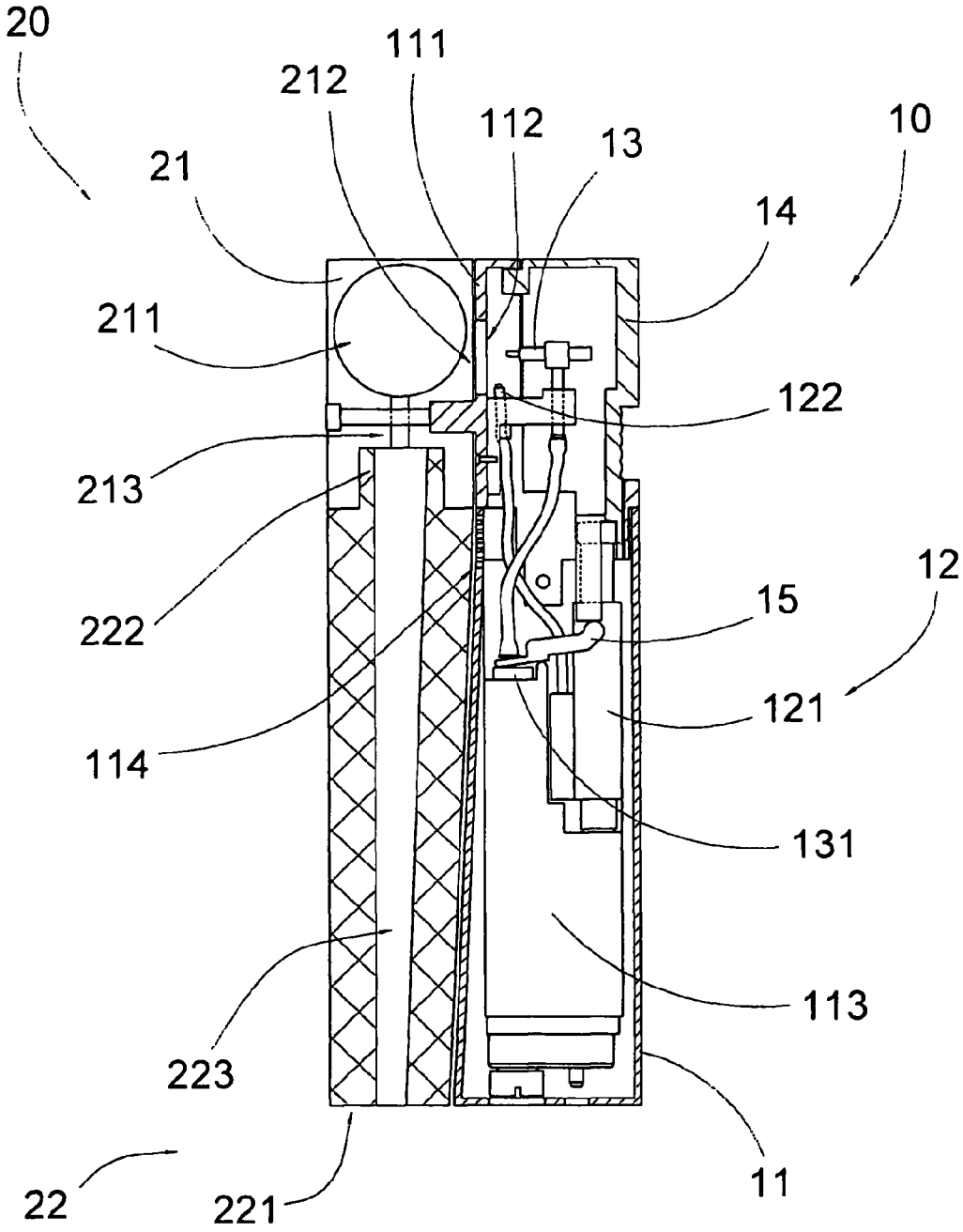
FIG. 3 is a top sectional view of the pipe lighter according to the above preferred embodiment of the present invention, illustrating the structural relationship between the lighter apparatus and the inhaler apparatus.

The ignition system 12, as shown in FIG. 3, is a sparks producing device which comprises a piezoelectric unit 121 supported within the lighter housing 11 for generating piezoelectricity, and an ignition tip 122 extended to a position closed to the flame nozzle 13. When the actuator 14 is actuated to press at the piezoelectric unit 121, sparks are generated at the ignition tip 122 to ignite the gas emitted from the flame nozzle 13 to produce the flame.

It is appreciated that the ignition system 12 can be a flint type ignition system wherein the spark can be produced via a flint and a striker wheel supported on the lighter housing 11.

The flame nozzle 13 is operatively extended from the fuel storage chamber 113 via a gas releasable valve 131, wherein a gas lever 15 is pivotally supported in the lighter housing 11 to engage with the gas releasable valve 131 and arranged in such a manner that when the actuator 14 is actuated to press at one end of the gas lever 15, the gas lever 15 is pivotally moved to open the gas releasable valve 131 for releasing the gas from the fuel storage chamber 113 to the flame nozzle 13. In other words, when the actuator 13 is actuated, the ignition system 12 is actuated to produce the spark while the gas releasable valve is actuated to release the gas at the same time to produce the flame at the flame nozzle 13 through the flame opening 112.

The actuator 14 is slidably mounted on the lighter housing 11 and is attached to a top end of the ignition system 12, wherein the actuator 14 is embodied as a pusher button for the smoker to depress so as to complete the ignition operation of the lighter apparatus 10. Preferably, the lighter apparatus produces the visible flame. Alternatively, the lighter apparatus can produce a windproof flame such as torch flame when the flame nozzle 13 is a torch nozzle.

Figure 4:
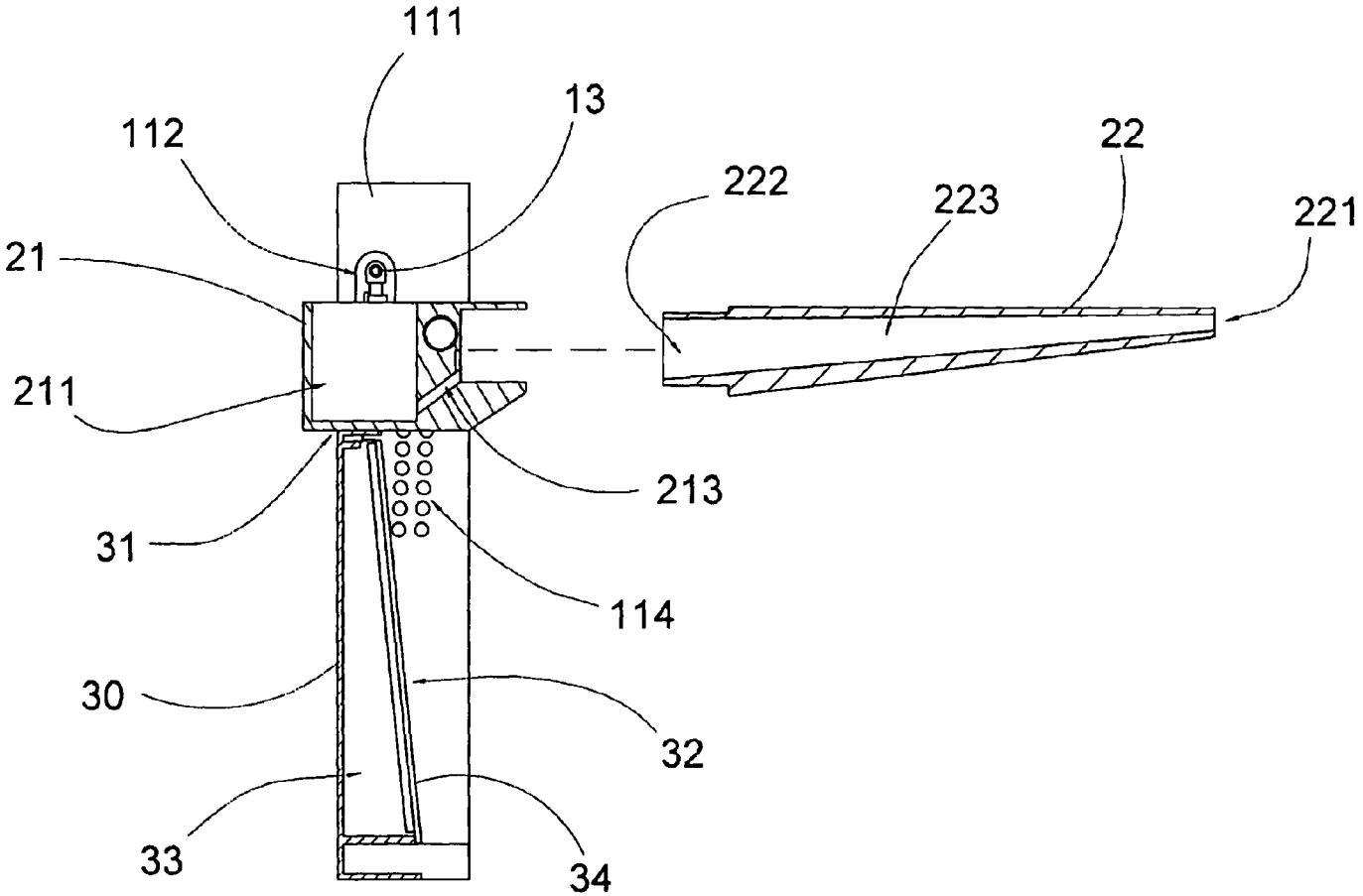
FIG. 4 is a side sectional view of the pipe lighter according to the above preferred embodiment of the present invention, illustrating the structural configuration between the flame opening and the substance chamber.

As shown in FIGS. 2 and 4, the lighter housing 11 further has a plurality of ventilating holes 114 spacedly formed on the housing sidewall 111 of the lighter housing 11 to communicate with an interior thereof for enhancing an air circulation of the lighter housing 11 when the lighter apparatus 10 is actuated for ignition. In addition, the ventilating holes 114 are adapted to maintain continuity of enough fresh air supplies and to prevent the heat accumulating within the lighter housing 11. It is worth mentioning that when the inhaler apparatus 20 is pivotally folded at the folded position, the ventilating holes 114 are covered by the inhaling guider 22 in a hidden manner, and when the inhaler apparatus 20 is pivotally folded at the unfolded position, the ventilating holes 114 are exposed for enhancing an air circulation of the lighter housing 11 when the lighter apparatus 10 is actuation for ignition.

As shown in FIGS. 1 and 2, the inhaler apparatus 20 is foldably coupled with the lighter apparatus 10. In particularly, the crucible unit 21 has a coupling sidewall 212 pivotally coupling with the housing sidewall 111 of the lighter housing 11 such that the inhaler apparatus 20 is adapted to pivotally move between a folded position, as shown in FIG. 1, and an unfolded position, as shown in FIG. 2.

Accordingly, at the folded position, the inhaler apparatus 20 is pivotally folded to parallely extend from and aside the lighter apparatus 10 to overlap the coupling sidewall 212 of the crucible unit 21 with the housing sidewall 111 of the lighter housing 11 so as to form a compact box-shaped structure. Since the coupling sidewall 212 of the crucible unit 21 is overlapped with the housing sidewall 111 of the lighter housing 11, the flame opening 112 is covered by the coupling sidewall 211 of the crucible unit 21 in a hidden manner for preventing the flame being produced at the flame opening 112.

At the unfolded position, the inhaler apparatus 20 is perpendicularly extended from and aside the lighter apparatus 10. Accordingly, when the inhaler apparatus 20 is folded at the unfolded position, the crucible unit 21 is pivotally folded until the substance chamber 211 thereof is positioned adjacent to the flame opening 112 of the lighter housing 11. Therefore, the smoker is able to actuate the actuator 13 of the lighter apparatus 10 to produce the flame at the flame opening 112 and to burn the smoking substance in the substance chamber 211.

The inhaling guider 22 has a mouth-piece end 221, an opposed coupling end 222 coupling with the crucible unit 21, and an inhaler channel 223 extended from the coupling end 222 to the mouth-piece end 221 to communicate with the substance chamber 211 for an inhalation of the smoked through the inhaling guider 22. Once the smoking substance in the substance chamber 211 is burnt, the smoker is able to inhale the smoke through the inhaling guider 22. As shown FIG. 4, the crucible unit 21 further comprises a communication slot 213 extended from the substance chamber 211 to communicate with the coupling end 222 of the inhaling guider 22 such that the smoke at the substance chamber 211 is guided to flow to the inhaling guider 22 through the communication slot 213.

Preferably, the coupling end 222 of the inhaling guider 22 is detachably coupled with the crucible unit 21 such that the smoker is able to detach the inhaling guider 22 from the crucible unit 21 for cleaning purpose.

As shown in FIGS. 1, 2 and 4, the pipe lighter further comprises a side housing 30 sidewardly and integrally extended from the housing sidewall 111 of said lighter housing 11, wherein the side housing 30 has a top wall 31 and a front wall 32 arranged in such a manner that when the inhaler apparatus 20 is pivotally folded at the folded position, the inhaling guider 22 is folded to overlay on the front wall 32 of the side housing 30, and when the inhaler apparatus 20 is pivotally folded at the unfolded position, the crucible unit 21 is folded to overlay on the top wall 31 of the side housing 30. Therefore, the front wall 32 and the top wall 31 of the side housing 30 form as two folding guides for limiting a pivotal movement of the inhaling apparatus 20 between the folded and unfolded positions. In other words, the smoker is able to precisely fold the inhaler apparatus 20 between the folded position to ensure the flame opening 112 being covered by the crucible unit 21 and the unfolded position to ensure the substance chamber 211 being positioned adjacent to the flame opening 112 of the lighter housing 11.

As shown in FIGS. 2 and 4, the side housing 30 further has a substance compartment 33 formed at the front wall 32 for containing extra smoking substance to be smoked, and comprises a compartment cover 34 pivotally coupled at the front wall 32 to pivotally enclose the substance compartment 33. In other words, the compartment cover 34 becomes part of the front wall 32. It is worth to mention that in order to open the compartment cover 34, the inhaler apparatus 20 must be folded at the unfolded position. At the folded position, the compartment cover 34 is covered by the inhaler apparatus 20 to prevent the substance compartment 33 being accessed unintentionally.

As shown in FIG. 4, the side housing 30 has a trapezoid shape that a cross-sectional area of the substance compartment 33 is gradually reducing towards the top wall 31. Therefore, the smoker can easily open or close the compartment cover 34 to access the substance compartment 33 for depositing or withdraw the smoking substance therein. In particularly, the thickness of lighter housing 11, which is equal to the thickness of crucible unit 21, is also equal to the total thickness of inhaling guilder 22 and the side housing 22 as well. Thus, the thickness is consistent throughout, streamlining the shape. The inhaling guilder 22 and the substance compartment 33 are slightly tapered in order to facilitate use.

In order to use the pipe lighter of the present invention, the smoker is able to fold the inhaler apparatus 20 at the unfolded position and to place the smoking substance in the substance chamber 211 of the crucible unit 21. Then, by depressing the actuator 14, the lighter apparatus 10 will produce the flame at the flame opening 112 to burn the smoking substance. It is worth to mention that the flame opening 112 is formed at the housing sidewall 111 of the lighter housing 10 such that the flame nozzle 13 is longitudinally supported at the lighter housing 11 to produce the flame at the longitudinal direction of the lighter housing 10 so as to enhance the windproof ability of the flame. Once the smoking substance is burnt to generate the smoke, the smoker is able to inhale the smoke through the inhaler apparatus 20 instantly. Accordingly, a covering cap 23 is provided to removably cover at the substance chamber 211 of the crucible unit 21 when the pipe lighter is not in use.

The advantage of the present embodiment is its portability. The tobacco or other substance pipe and lighter are all contained in a single unit, such that there is only one item need to be carried.

It is worth mentioning that the size of the pipe lighter is comparable to a size of a disposable lighter. The user can easily handle the pipe lighter with one hand to burn and smoke the smoking substance.

Preferably, referring to FIGS. 5 to 8 of the drawings, the pipe lighter further comprises a burner unit 50 which is sized to fittingly and complimentarily engaging with the crucible unit 21 in such a manner that the burner unit 50 is capable of covering the substance chamber 211 and conducting heat emitted from the flame nozzle 13 to the substance chamber 211 so as to evenly transmit the heat to the substance chamber 211 in such a manner that the heat being transmitted is evenly distributed within the substance chamber 211. The burner unit 50 forms a heat reflector, thereby smoking substance is burnt in a controllable manner and is substantively maintained in the substance chamber 211 which is then guided to flow towards the tubular inhaling guider 22.

In particular, the burner unit 50 comprises a burner body detachably covering at the substance chamber 211 of the crucible unit 21. The burner body comprises a burner cover 51 and a burner sidewall 52 circumferentially and transversely extended from the burner cover 51 to define a burner cavity 53 therein, wherein the burner sidewall 52 is sized to fittingly receive inside the substance chamber 211 and is circumferentially engaging with a chamber sidewall 214 of the substance chamber 211 of the crucible unit 21 to form an enclosed oven chamber 54. Preferably, the burner cover 51 and the burner sidewall 52 are made of heat conductive materials to transmit heat to the oven chamber 54, thereby the heat emitted from the flame nozzle 13 is transmitted to and spread through the oven chamber 54 through the burner cover 51 and the burner sidewall 52.

Preferably, the burner unit 50 further comprises a heating member 55 circumferentially connected to the burner sidewall 52, wherein the heating member 55 is made of heat conductive materials such that the heat from the flame nozzle 13 is capable of being transmitted to and spread throughout the oven chamber 54.

According to one embodiment, the heating member 55 has a heat reflective surface made of heat conductive materials such that the heat from the flame nozzle 13 is capable of being transmitted to and spread throughout the oven chamber 54 through heat reflection. In addition, the heat reflective surface of the heating member 55 also forms a guiding surface to press against the smoking substance in the substance chamber 211 of the crucible unit 21. Therefore, the smoker is able to adjustably control the tightness of the smoking substance by the pressing action of the heating member 55. The smoker can make the smoking substance as tight or as loose as he or she wants, depending on the preferences. Further, the smoking substance will be retained in and covered by the burner unit 50 to prevent the smoking substance being accidentally dropped out of the substance chamber 211 of the crucible unit 21, such as during the windy condition.

According to another embodiment, the heating member 55, having a mesh structure, has a plurality of heating holes 551 spacedly and evenly provided on the heat reflective surface of the heating member 55 for enabling air passing into the oven chamber 54 and evenly distributing heat therein, thereby smoking substance provided in the oven chamber 54 is capable of being heated through the heating member 55 and any smoke emitted from the smoking substance is capable of passing through the heating holes 551 which is then guided towards the tubular inhaling guider 22.

Preferably, the burner unit 50 comprises a cover conduit 56 having a first end 561 upwardly extended from the burner cover 51 and a second end 562 opposed to the first end 561 defining a flame contact portion 563 which is aligned with and positioned at the same level as the flame nozzle 13 when the burner unit 50 is coupled with the crucible unit 21 at the unfolded position. The cover conduit 56 has a tubular structure and defines an air channel to communicate with the burner cavity 53 for enabling air being passed through the air channel into the burner cavity 53. In other words, the burner unit 50 defines the flame contact portion 563 to align with the flame nozzle 13 to thermally conduct the heat to the oven chamber 54 for the combustion of the smoking substance.

When the flame nozzle 13 produces the flame, the flame will directly contact with the flame contact portion 563 such that the heat will be transmitted from the cover conduit 56 to the heating member 55. Therefore, the oven chamber 54 will be heated up for combustion of the smoking substance to be smoked and for an inhalation of smoked through the inhaling guider 22. In addition, during the inhalation of the smoked through the inhaling guider 22, the air will guide to fill into the substance chamber 211 of the crucible unit 21 through the air channel of the cover conduit 56. Preferably, the cover conduit 56 is transversely extended from a center of the burner cover 51 such that heat transfer at the center can be evenly channeled through the cover conduit 56.

Accordingly, the heat from the flame nozzle 13 is transmitted from the center of the burner cover 51 through the cover conduit 56 to the heating member 55. The heat is then spread radially and downwardly towards the burner sidewall 52 through the burner cover 51, while the heating member 55 is capable of receiving the heat both in a peripheral manner through the burner sidewall 52 and at a center through the cover conduit 56, thereby achieving an evenly distributed heating effect in the oven chamber 54.

Preferably, the flame contact portion 563 has an enlarged head such that the flame contact portion 563 has an increased surface area to facilitate heat transfer while serving as a handle for the burner unit 50. It is worth mentioning that the enlarged head of said flame contact 563 also provides a connecting head for tying the burner unit 50 to the lighter housing 11 of the lighter apparatus.

Accordingly, since the heat from the flame at the flame nozzle 13 is transmitted and reflected to the substance chamber 211, the heat will not directly apply to the smoking substance so as to prevent the heat directly burning the smoking substance. In addition, the heat is transmitted to the smoking substance through the heating holes 551 of the heating member 55 to generate a baking effect within the oven chamber 54 so as to generate a vapor effect during the combustion of the smoking substance. Therefore, the heating element 55 forms as a heating filter to minimize nicotine and tar during the combustion of the smoking substance.

Figure 5:
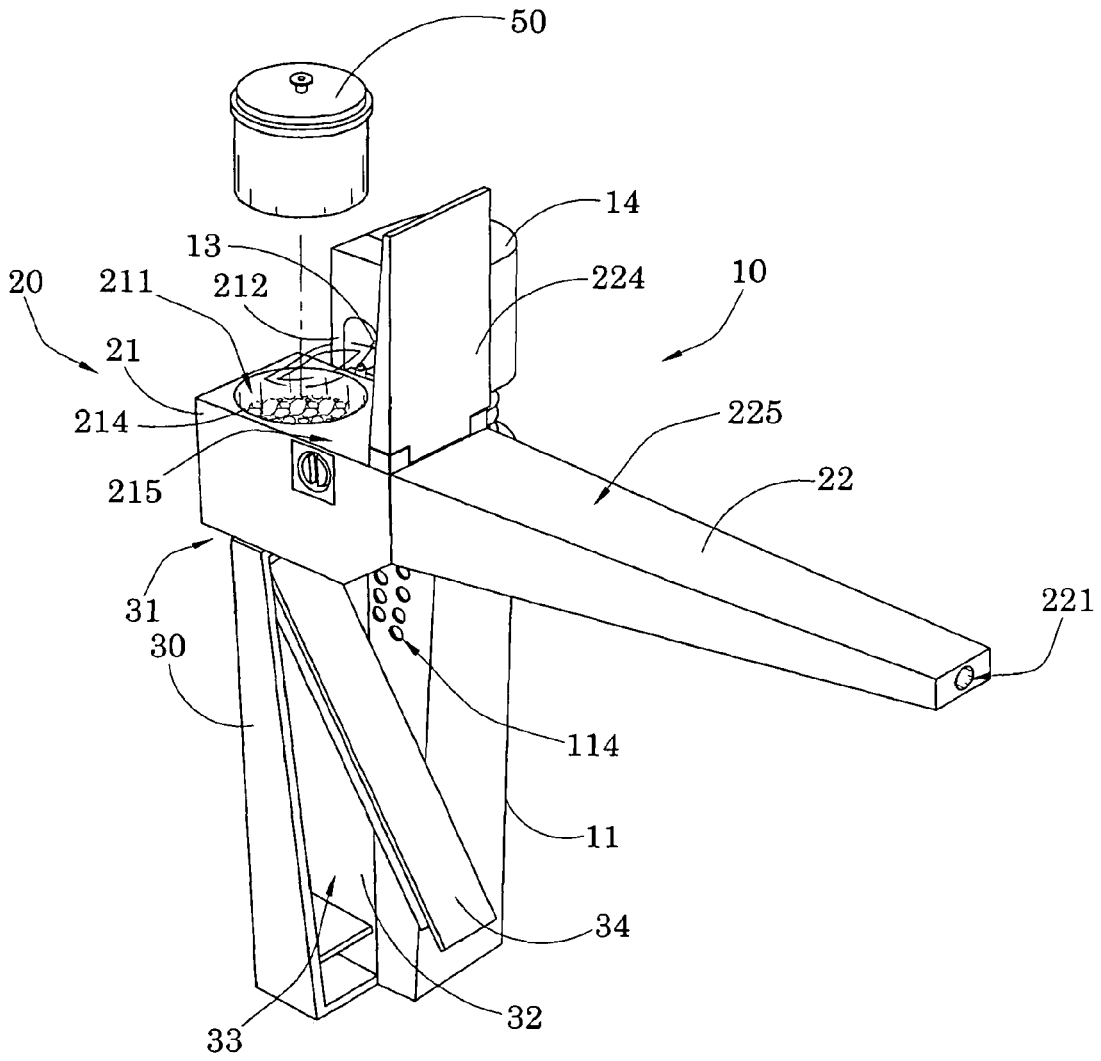
FIG. 5 is a perspective view of a pipe lighter according to an alternative mode of the above preferred embodiment of the present invention, illustrating the pipe lighter being folded at an unfolded position.
Figure 6:
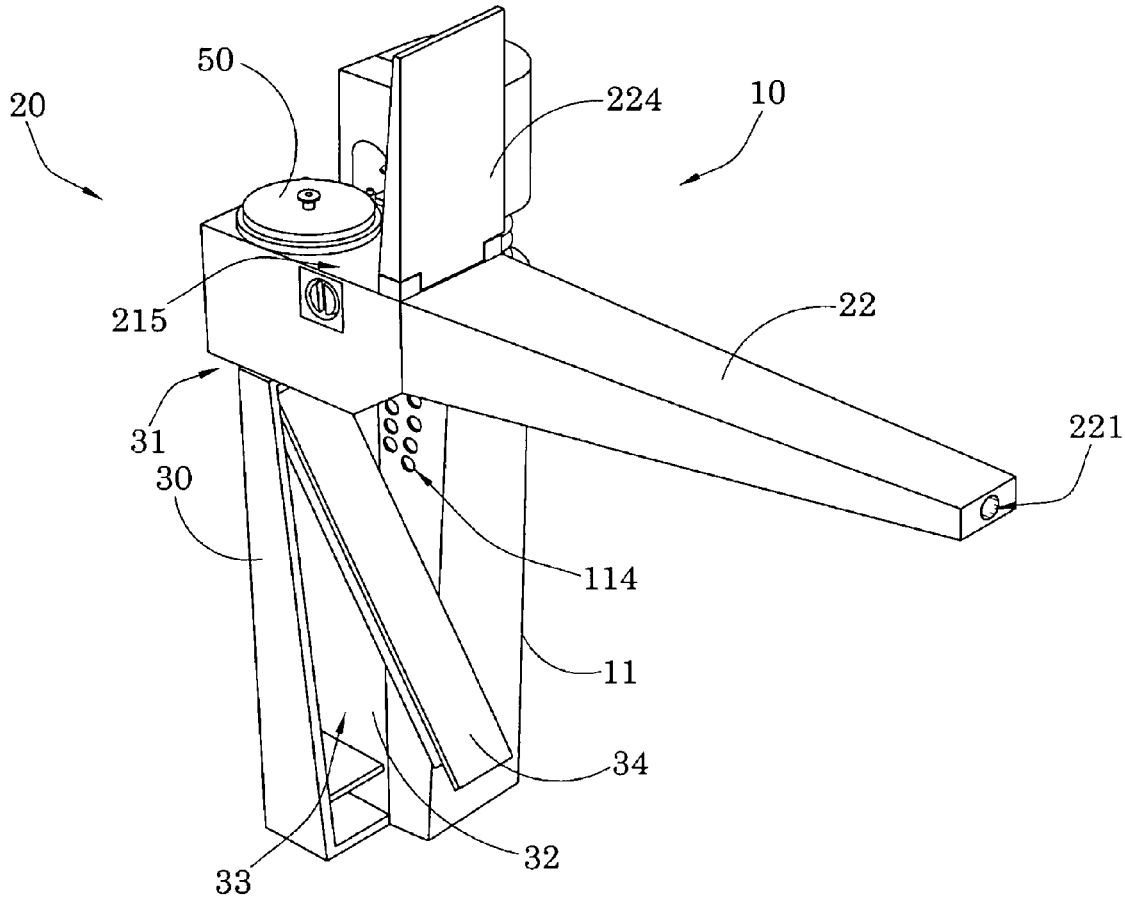
FIG. 6 is a perspective view of the pipe lighter according to the alternative mode of the above preferred embodiment of the present invention, illustrating the burner unit fitting in the crucible unit.
Figure 7:
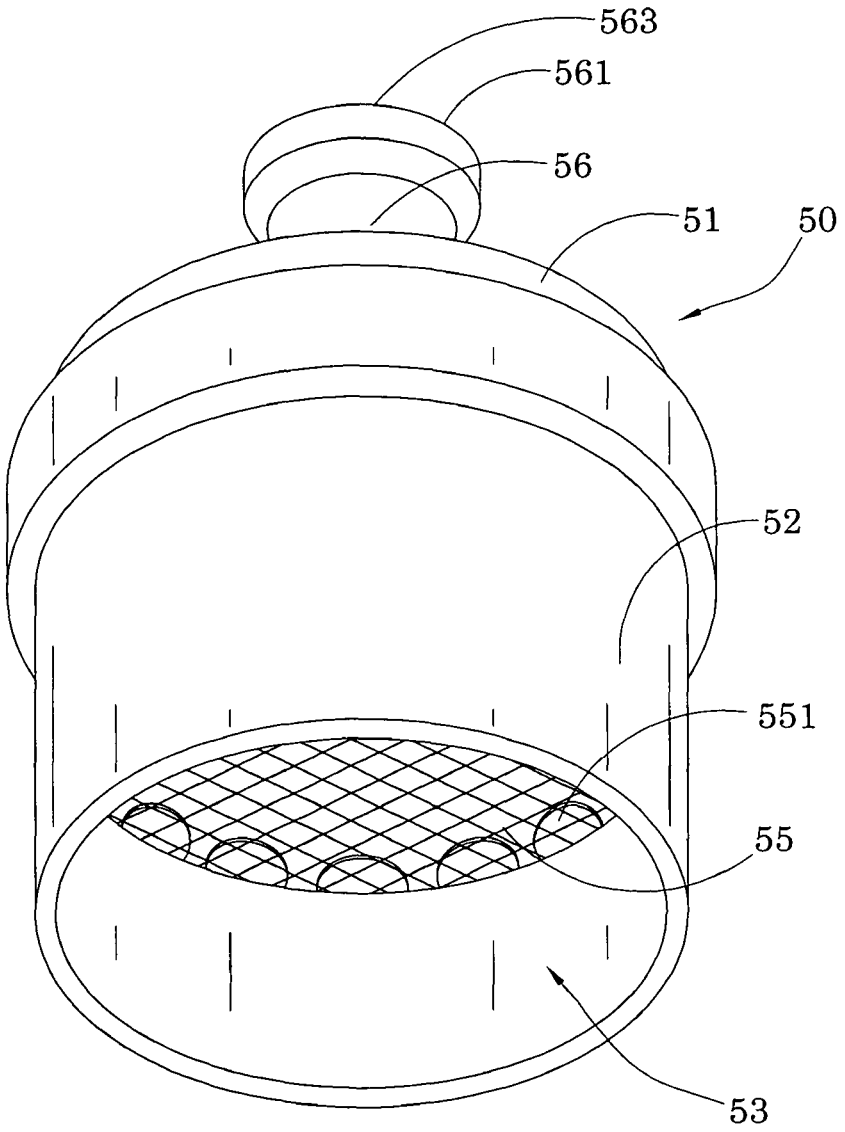
FIG. 7 is a perspective view of the burner unit of the pipe lighter according to the alternative mode of the above preferred embodiment of the present invention.
Figure 8:
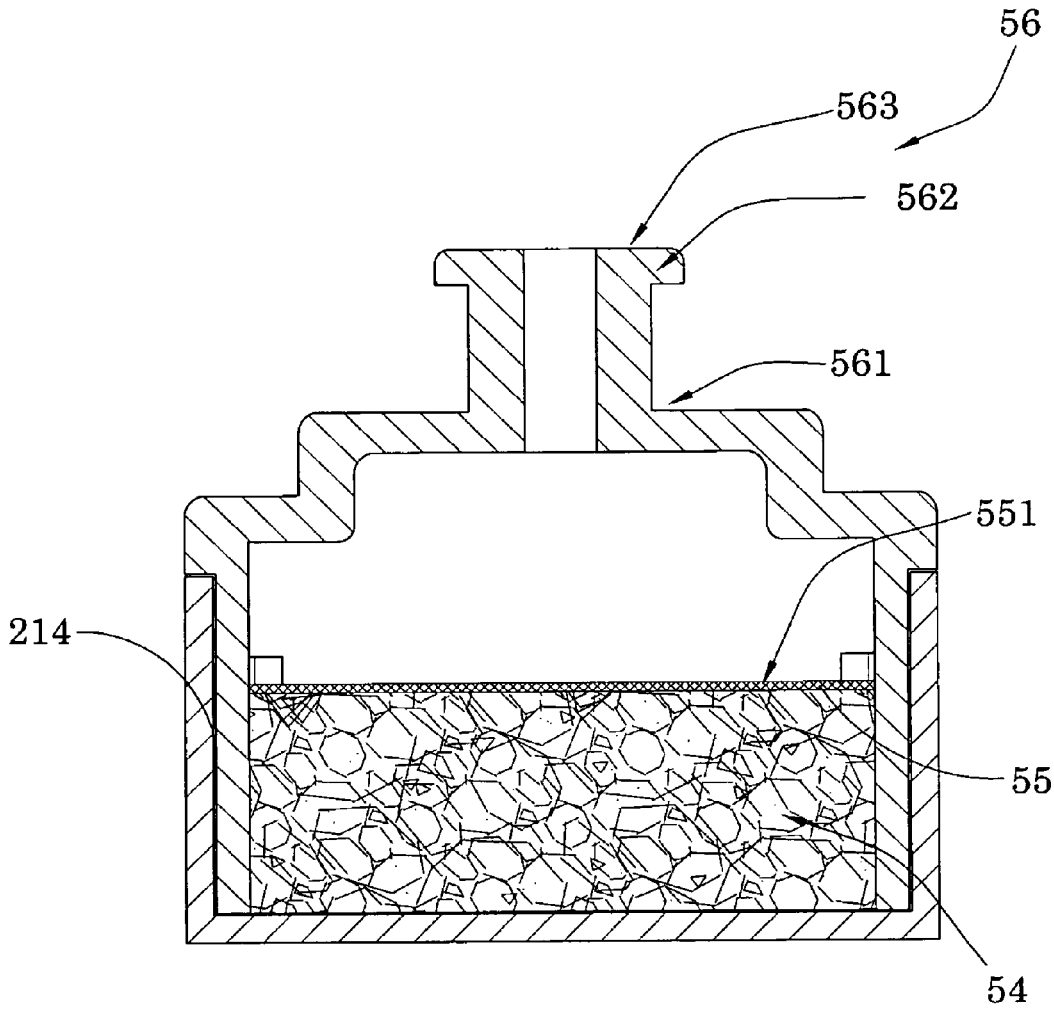
FIG. 8 is an illustration of the operation of the burner unit in relation to the crucible unit of the pipe lighter according to the alternative mode of the above preferred embodiment of the present invention.

Referring to FIGS. 5 and 6 of the drawings, the pipe lighter further comprises a cover unit 224 provided on the coupling end of the inhaling guider 22. The cover unit 224 is pivotally connected to the coupling end to provide a vertical position that is perpendicular to a top surface 215 of the crucible unit 21 such that the cover unit 224 is positioned transversely relative to the housing sidewall 111 of the lighter housing 11 at one end of the housing sidewall 111 so as to enclose the flame produced from the flame nozzle 13 at one side, and a horizontal position that is approximately parallel to the top surface 215 of the crucible unit 21 such that the cover unit 224 is laying on a front surface 225 of the inhaling guider fittingly in a compact manner. In other words, the cover unit 224 can be folded to the vertical position for blocking wind to the flame from the flame nozzle 13 and folded to receive on the inhaling guider 22.

Preferably, the cover unit 224 is sized to fit a portion of the front surface 225 for maintaining the compact structural construction of the pipe lighter. In particular, the cover unit 224 has a trapezoid shape that is complimentary to the front surface 225 of the inhaling guider 22. It is worth mentioning that an additional cover unit 224 can also be pivotally provided on the crucible unit 211 to position transversely relative to the housing sidewall 111 of the lighter housing 11 at the other end of the housing sidewall 111 such that the additional cover unit 224 can be used to further enclose the flame nozzle. The additional cover unit 224 can be fittingly received on a side of the crucible unit 211.

Figure 9:
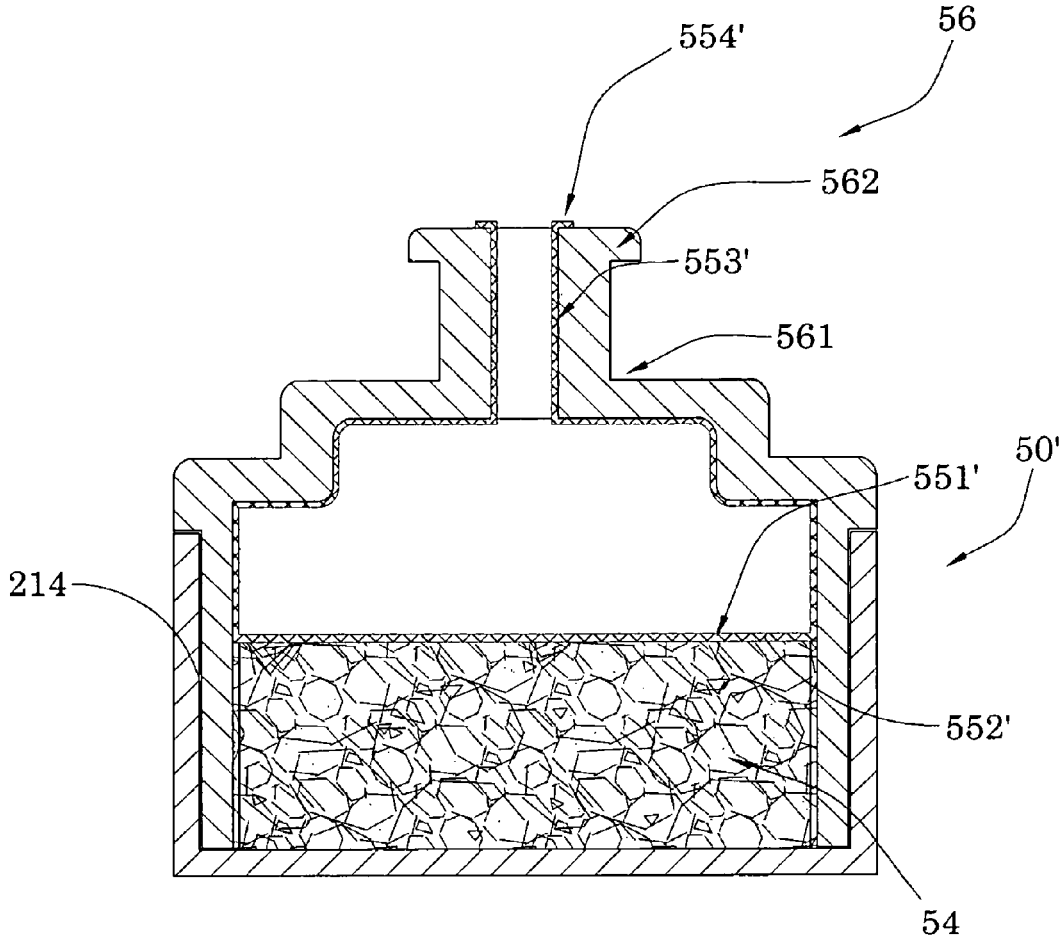
FIG. 9 illustrates an alternative mode of the heating member of the burner unit of the pipe lighter according to the alternative mode of the above preferred embodiment of the present invention.

FIG. 9 illustrates an alternative mode of the heating member 55' received in the burner body for transmitting to and spreading throughout the oven chamber 54. As shown in FIG. 9, the heating member 55' has a net-shaped heat reflective surface 552', defining the heating holes 551' thereat, supported within the burner sidewall 52 to transmit and spread the heat throughout the oven chamber 54 and a retention portion 553' upwardly extended through the air channel of the cover conduit 56. In other words, the heating member 55' is formed at the inner surface of the burner body such that the heat will be transmitted from the retention portion 553' of the heating member 55' to the heat reflective surface 552' thereof. It is worth mentioning that the upper end of the retention portion 553' of the heating member 55' is preferably protruded out of the top end of the conduit 56 to form a flame contact portion 554' which is aligned with and positioned at the same level as the flame nozzle 13 for enabling the flame reaching the heating member 55'. In addition, the burner cover 51 and the burner sidewall 52 are preferably made of heat insulated material or heat resistance material.

The pipe lighter of the present invention provides a single device for smoking while having a size similar to a disposable lighter. The provision of the burner unit 50 has greatly enhanced the burning effect and the operation of the pipe lighter of the present invention.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A pipe lighter, comprising: a lighter apparatus which comprises a lighter housing having a flame opening and a fuel storage chamber for storing liquefied gas therewithin, an ignition unit supported within said lighter housing, a flame nozzle operatively extended from said fuel storage chamber to said flame opening for releasing said gas in a controllable manner, and an actuator which is movably supported on said lighter housing and is arranged in such a manner that when said actuator is depressed, said gas in said fuel storage chamber is released towards said flame nozzle while said ignition unit is activated for igniting said gas at said flame nozzle so as to produce a flame through said flame opening; and an inhaler apparatus, which is pivotally coupled with said lighter apparatus side-by-side to pivotally move between a folded position and an unfolded position, comprising a crucible unit having a substance chamber for retaining a smoking substance in said substance chamber, and a tubular inhaling guider extended from said crucible unit, wherein when said inhaler apparatus is pivotally folded at said folded position, said flame opening is covered by said crucible unit in a hidden manner for preventing said flame being produced at said flame opening, and when said inhaler apparatus is pivotally folded at said unfolded position, said crucible unit is moved until said substance chamber is positioned adjacent to said flame opening of said lighter housing, such that said lighter apparatus is actuated to produce said flame for a combustion of said smoking substance to be smoked and for an inhalation of said smoked through said inhaling guider.

2. The pipe lighter, as recited in claim 1 further comprising a burner unit detachably fitting at said crucible unit to cover said substance chamber thereof, wherein said burner unit is adapted for covering said substance chamber and conducting heat emitted from said flame nozzle to said substance chamber so as to evenly transmit said heat to said substance chamber for combustion of said smoking substance.

3. The pipe lighter, as recited in claim 2, wherein said burner unit has an oven chamber within said substance chamber when said burner unit is coupled at said crucible unit, and a flame contact portion aligned with said flame nozzle for thermally conducting said heat from said flame contact portion to said oven chamber.

4. The pipe lighter, as recited in claim 2, wherein said burner unit comprises a burner body detachably covering at said substance chamber and a cover conduit upwardly extended from said burner body, wherein said cover conduit has an air channel for communicating with said substance chamber for enabling air passing thereinto.

5. The pipe lighter, as recited in claim 3, wherein said burner unit comprises a burner body detachably covering at said substance chamber and a cover conduit upwardly extended from said burner body, wherein said cover conduit has an air channel for communicating with said substance chamber for enabling air passing thereinto.

6. The pipe lighter, as recited in claim 5, wherein said oven chamber is formed within said burner body and said flame contact portion is defined at an upper end of said cover conduit.

7. The pipe lighter, as recited in claim 2, wherein said burner unit further comprises a heating member which is made of heat conductive material and is supported within said burner body, wherein aid heating member has a heat reflective surface for controllably pressing against said smoking substance in said substance chamber and for evenly distributing said heat from said burner body to said smoking substance.

8. The pipe lighter, as recited in claim 3, wherein said burner unit further comprises a heating member which is made of heat conductive material and is supported within said burner body, wherein aid heating member has a heat reflective surface for controllably pressing against said smoking substance in said substance chamber and for evenly distributing said heat from said burner body to said smoking substance.

9. The pipe lighter, as recited in claim 6, wherein said burner unit further comprises a heating member which is made of heat conductive material and is supported within said burner body, wherein aid heating member has a heat reflective surface for controllably pressing against said smoking substance in said substance chamber and for evenly distributing said heat from said burner body to said smoking substance.

10. The pipe lighter, as recited in claim 7, wherein said heating member has a plurality of heating holes spacedly and evenly provided on said heat reflective surface for enabling air passing therethrough and evenly distributing heat to said smoking substance.

11. The pipe lighter, as recited in claim 8, wherein said heating member has a plurality of heating holes spacedly and evenly provided on said heat reflective surface for enabling air passing therethrough and evenly distributing heat to said smoking substance.

12. The pipe lighter, as recited in claim 9, wherein said heating member has a plurality of heating holes spacedly and evenly provided on said heat reflective surface for enabling air passing therethrough and evenly distributing heat to said smoking substance.

13. The pipe lighter, as recited in claim 12, wherein said burner body is made of heat conductive material to transmit and evenly distribute said heat to said substance chamber through said heating member.

14. The pipe lighter, as recited in claim 12, wherein said burner body is made of heat resistance material, wherein said heating member further has a retention portion upwardly extended from said heat reflective surface to said cover conduit and to define said flame contact portion at said upper end of said cover conduit.

15. The pipe lighter, as recited in claim 2, wherein said inhaling guider has a mouth-piece end, an opposed coupling end detachably coupled with said crucible unit, and an inhaler channel extended from said coupling end to said mouth-piece end to communicate with said substance chamber for an inhalation of said smoked through said inhaling guider.

16. The pipe lighter, as recited in claim 12, wherein said inhaling guider has a mouth-piece end, an opposed coupling end detachably coupled with said crucible unit, and an inhaler channel extended from said coupling end to said mouth-piece end to communicate with said substance chamber for an inhalation of said smoked through said inhaling guider.

17. The pipe lighter, as recited in claim 15, further comprising a side housing sidewardly and integrally extended from said lighter housing, wherein said side housing has a top wall and a front wall arranged in such manner that when said inhaler apparatus is pivotally folded at said folded position, said inhaling guider is folded to overlay on said front wall of said side housing, and when said inhaler apparatus is pivotally folded at said unfolded position, said crucible unit is folded to overlay on said top wall of said side housing, such that said front wall and said top wall of said side housing form as two folding guides for limiting a pivotal movement of said inhaler apparatus between said folded position and said unfolded position, wherein said side housing further has a substance compartment formed at said front wall for containing said smoking substance to be smoked within said substance compartment, and comprises a compartment cover pivotally coupled at said front wall to pivotally enclose said substance compartment.

18. The pipe lighter, as recited in claim 16, further comprising a side housing sidewardly and integrally extended from said lighter housing, wherein said side housing has a top wall and a front wall arranged in such manner that when said inhaler apparatus is pivotally folded at said folded position, said inhaling guider is folded to overlay on said front wall of said side housing, and when said inhaler apparatus is pivotally folded at said unfolded position, said crucible unit is folded to overlay on said top wall of said side housing, such that said front wall and said top wall of said side housing form as two folding guides for limiting a pivotal movement of said inhaler apparatus between said folded position and said unfolded position, wherein said side housing further has a substance compartment formed at said front wall for containing said smoking substance to be smoked within said substance compartment, and comprises a compartment cover pivotally coupled at said front wall to pivotally enclose said substance compartment.

19. The pipe lighter, as recited in claim 17, wherein said lighter housing further has a plurality of ventilating holes spacedly formed on said lighter housing to communicate with an interior thereof, wherein when said inhaler apparatus is pivotally folded at said folded position, said ventilating holes are covered by said inhaling guider in a hidden manner, and when said inhaler apparatus is pivotally folded at said unfolded position, said ventilating holes are exposed for enhancing an air circulation of said lighter housing when said lighter apparatus is actuation for ignition.

20. The pipe lighter, as recited in claim 18, wherein said lighter housing further has a plurality of ventilating holes spacedly formed on said lighter housing to communicate with an interior thereof, wherein when said inhaler apparatus is pivotally folded at said folded position, said ventilating holes are covered by said inhaling guider in a hidden manner, and when said inhaler apparatus is pivotally folded at said unfolded position, said ventilating holes are exposed for enhancing an air circulation of said lighter housing when said lighter apparatus is actuation for ignition.

* * * * *